US005472183A

United States Patent [19]

Kubo

[11] Patent Number: 5,472,183

[45] Date of Patent: Dec. 5, 1995

[54] SHEET FEEDING DEVICE WITH MULTIPLE SHEET STACKERS

[75] Inventor: Masayoshi Kubo, Kofu, Japan

[73] Assignee: Nisca Corporation, Yamanashi, Japan

[21] Appl. No.: 214,381

[22] Filed: Mar. 17, 1994

[51] Int. Cl.[6] ..... B65H 3/44; B65H 5/26

[52] U.S. Cl. ..... 271/9.03; 271/110; 271/117; 271/126; 271/152

[58] Field of Search ..... 271/9, 110, 117, 271/126, 152–156, 162, 164

[56] References Cited

U.S. PATENT DOCUMENTS

| | | | |
|---|---|---|---|
| 5,078,382 | 1/1992 | Tanjo et al. | 271/117 X |
| 5,102,112 | 4/1992 | Takahashi | 271/9 |
| 5,123,637 | 6/1992 | Musaka | 271/117 |
| 5,195,734 | 3/1993 | Tanabe | 271/9 |
| 5,259,606 | 11/1993 | Takahashi | 271/9 |

FOREIGN PATENT DOCUMENTS

| | | | |
|---|---|---|---|
| 6538 | 1/1985 | Japan . | |
| 313223 | 12/1989 | Japan | 271/110 |
| 204237 | 8/1990 | Japan . | |
| 192032 | 8/1991 | Japan . | |
| 101934 | 4/1992 | Japan . | |
| 97262 | 4/1993 | Japan . | |

*Primary Examiner*—H. Grant Skaggs
*Attorney, Agent, or Firm*—Kane, Dalsimer, Sullivan, Kurucz, Levy, Eisele and Richard

[57] ABSTRACT

A sheet feeding device is provided with abreast sheet stackers each having an elevating tray for stacking sheets, which can be held at an upper sheet send-out position when no sheet is stacked. The elevating tray which remains stationary at the send-out position when the stacker becomes empty of sheet serves as a sheet guide member for delivering the sheet discharged from the adjoining sheet stacker to an image processing device such as a copying machine through a sheet transfer path. Since the stackers other than the first stacker do not necessitate a sheet separator nor sheet transfer path, the device can be simplified without deteriorating the sheet feeding performance and manufactured at a low cost.

8 Claims, 7 Drawing Sheets

SHEET FEEDING DEVICE WITH MULTIPLE SHEET STACKERS

BACKGROUND OF THE INVENTION

1. Field of the Invention

This invention relates to a device for automatically feeding sheets one by one to an image processing device such as a copying machine, and more particularly to a high-performance sheet feeding device provided with abreast sheet stackers for accommodating a mass of sheets so as to rationally feed the sheets from one selected from the sheet stackers to various image processing devices.

2. Description of the Prior Art

Attendant on an image processing device typified by a copying machine and printer which handles sheets such as copying and printing papers, not infrequently, there have been used ancillary sheet feeding devices for storing a mass of sheets and feeding the sheets one by one to the image processing device. To lessen the labor of loading the image processing device or sheet feeding device with the sheets which often becomes onerous, mass-storage sheet stackers capable of loading a large quantity of sheets at a time have come to be adopted to the image processing device. The sheet feeding devices of this type by and large have a plurality of sheet stackers for storing stacks of sheets of different sizes or the same size.

According to the arrangement of the sheet stackers, the ancillary sheet feeding device to be attached to the image processing device may be classified for convenience' sake into a horizontal abreast type (e.g. Japanese Patent Application Public Disclosure No. HEI 5-97262(A)), a vertically arranged type (e.g. Japanese Pat. Appln. Pub. Discl. No. HEI 60-6538(A)), and a composite type (e.g. Japanese Pat. Appln. Pub. Discl. No. HEI 2-204237(A)).

Any type of sheet feeding device with a plurality of sheet stackers has a function of switching the sheet stackers so that, when one of the sheet stackers becomes empty of sheet, the sheets contained in the other sheet stacker can be sent out one by one in succession. To fulfill such a function, the conventional sheet feeding device is generally formed simply by arranging two or more sheet stacker units side by side which each have sheet transferring means so as to send out the sheets one by one by itself. Thus, the sheet feeding device formed merely by combining sheet stacker units capable of functioning independently becomes bulky double or more as many as a sheet feeding device having a single sheet stacker unit, and is complicated because each stacker unit necessitates a sheet transfer path leading to a sheet discharge port of the sheet feeding device and other independent elements for the exclusive use of the respective sheet stackers.

In general, the sheet stacker units mounted in the sheet feeding device each possess sheet separating means ordinarily formed of a pair of rollers for permitting one sheet to pass therethrough in addition to the sheet drawing-out means for drawing out the sheet from the stacker. Accordingly, there has been so far a limit in making the sheet feeding device compact because the adjoining sheet stacker units with the respective sheet drawing-out means and sheet separating means cannot be disposed close to each other.

To be more specific, the typical of the conventional sheet feeding device of the horizontally abreast type of which an image processing device M such as a copying machine comprises first and second sheet stackers 2*a* and 2*b* placed side by side as schematically shown in FIGS. 1(A) and 1(B).

The sheet feeding device of this type is disclosed in the aforenoted Japanese Pat. Appln. Pub. Discl. No. HEI 5-97262, for instance.

The first and second sheet stackers 2*a* and 2*b* in the sheet feeding device 1 each have an elevating tray 3 on which a stack of sheets SS are placed, a sheet draw-out roller 5 for drawing out the uppermost sheet of the stack of sheet SS, and a pair of sheet separation rollers 6 disposed nearby the sheet exit of the stacker for permitting only one sheet to pass therebetween to prevent a so-called "double-feed phenomenon."

When giving an image processing command to the image processing device M, the sheet draw-out roller 5 of the first stacker 2*a* is operated to draw out the uppermost sheet from the stacker 2*a*. The sheet drawn out from the stacker 2*a* is sent to the sheet discharge port 7 through the sheet separation rollers 6 and a first transfer path P1 and introduced into the image processing device M.

The stack of sheets SS on the elevating tray 3 in the first stacker 2*a* is elevated with successive sheet feeding operation, so that the uppermost of the sheets SS stacked on the tray 3 is always situated at an upper sheet send-out position so as to come into contact with the draw-out roller 5.

When the first sheet stacker 2*a* becomes empty of sheet, the sheets SS in the second sheet stacker 2*b* are uninterruptedly sent out one by one by driving the draw-out roller 5 and the sheet separation rollers 6 of the second sheet stacker 2*b* as shown in FIG. 1(B). The sheet drawn out from the second sheet stacker 2*b* is delivered along a second transfer path P2 and introduced into the image processing device M via the sheet discharge port 7.

As is apparent from the above, every sheet stacker disposed in the conventional sheet feeding device necessitates individual sheet sending-out means including the draw-out roller, the sheet separation rollers and the transfer path with some pair of feeding rollers 8 for the exclusive use thereof. Thus, the aforenoted structure in the conventional sheet feeding device is disadvantageously complicated and can by no means materialize miniaturization of an image processing system.

OBJECT OF THE INVENTION

An object of the present invention is to provide a sheet feeding device having a simplified sheet containing structure and sheet sending-out means and capable of rationally feeding sheets one by one through a single sheet transfer path to an image processing device such as a copying machine with high efficiency, thus contributing to miniaturization of a general image processing system including the image processing device.

Another object of this invention is to provide a sheet feeding device made simple in structure, capable of preventing failure to feed the sheet, heightening the performance and reliability of sheet feeding, and composing an image processing system at a low cost.

SUMMARY OF THE INVENTION

To attain the objects described above according to the present invention, there is provided a sheet feeding device for feeding sheets one by one to an image processing device, which comprises sheet stackers arranged abreast and each having an elevating tray for stacking the sheets thereon, and a sheet draw-out roller placed so as to come into contact with the elevating tray situated at an upper sheet send-out position, and a sheet transfer path extending from one of the sheet stackers to a sheet discharge port through which the sheet is fed into the image processing device. The elevating tray in the sheet stacker is held at the upper sheet send-out position, when the sheet stacker becomes empty of sheet, so as to guide a sheet being sent out from the adjoining sheet stacker to the sheet transfer path leading to the image processing device.

There is disposed one sheet separating means at the sheet exit of the first stacker so as to permit only one sheet to pass therethrough.

According to this structure, the elevating tray of the first sheet stacker serves as sheet guiding means for the sheet sent out from one of the second and successive sheet stackers, and therefore, there is no need for an independent sheet transfer path for the exclusive use of the sheets sent out from the successive sheet stackers other than the first sheet stacker.

Between the adjoining sheet stackers, another sheet separating means may be disposed to infallibly prevent two or more sheets from being fed at a time.

The sheet feeding device can be constructed in various ways by, for example, placing the sets of abreast sheet stackers one upon another, or being provided with one or more sheet cartridges for containing sheets of different sizes under one set of abreast sheet stackers.

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

Other objects and features of the present invention will be hereinafter explained in detail with reference to the accompanying drawings, wherein.

DESCRIPTION OF THE PREFERRED EMBODIMENTS

This invention will become more fully understood from the detailed description given hereinbelow and the accompanying drawings which are given by way of illustration only, and thus are not limitative of the present invention.

The sheet feeding device of this invention is attached to an image processing device typified by a copying machine, printer, facsimile and printing machine handling sheets such as copying and printing papers, and is provided with a plurality of sheet stackers capable of containing masses of sheets, which are arranged abreast and made simple in structure, so that the sheets can be rationally fed one by one to the image processing device while materializing miniaturization of the sheet feeding device.

Figure 1A:
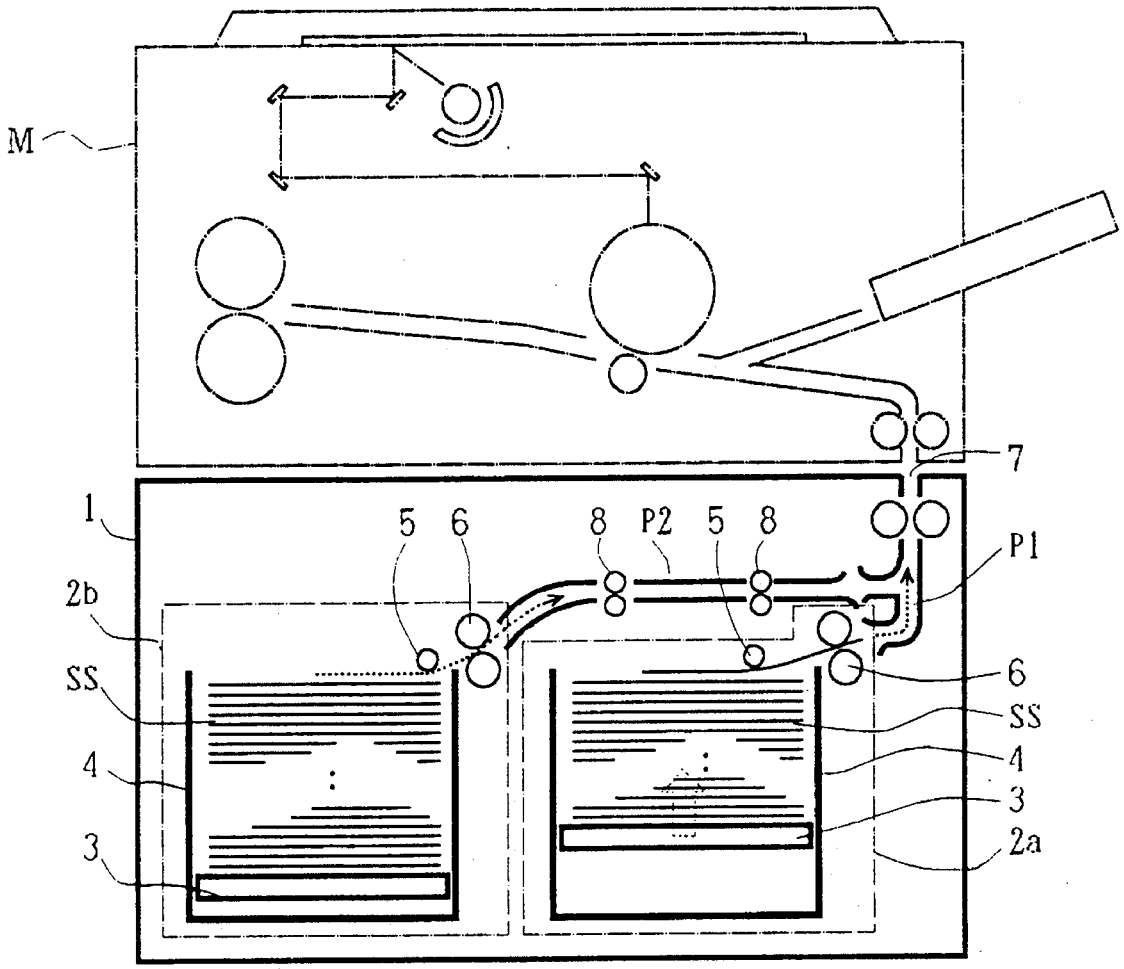
FIG. 1(A) (PRIOR ART)
FIG. 1(A) and FIG. 1(B) are schematic side views showing a conventional sheet feeding device.
Figure 1B:
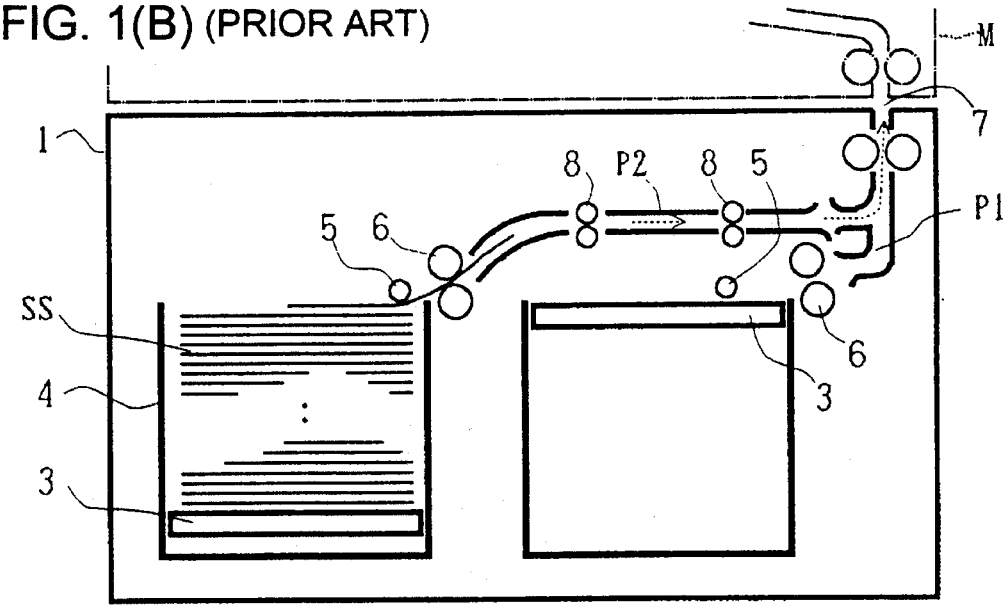
FIG. 1(B) (PRIOR ART)
Figure 2A:
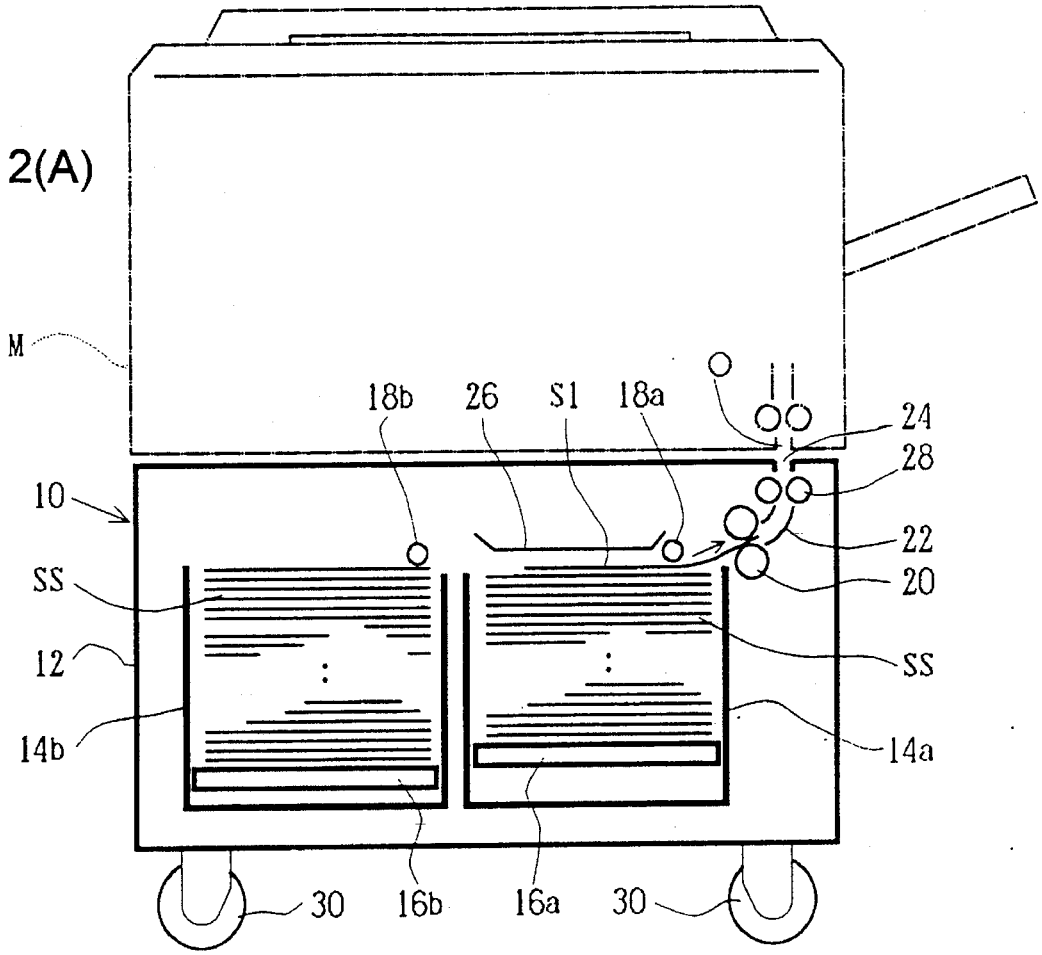
FIG. 2(A) and FIG. 2(B) are schematic side views showing a fundamental structure of this invention.

As shown in FIG. 2(A), the image processing device M is placed on the sheet feeding device 10 of this invention and has a sheet inlet opening O opposite a sheet discharge port 24 of the sheet feeding device. The sheets contained in the sheet feeding device 10 are fed one by one to the image processing device M through the sheet inlet opening O. Although the image processing device M in this illustrated embodiment may appear prima facie to be a copying machine, it should not be understood as limitative and may of course be of any type.

Figure 2B:
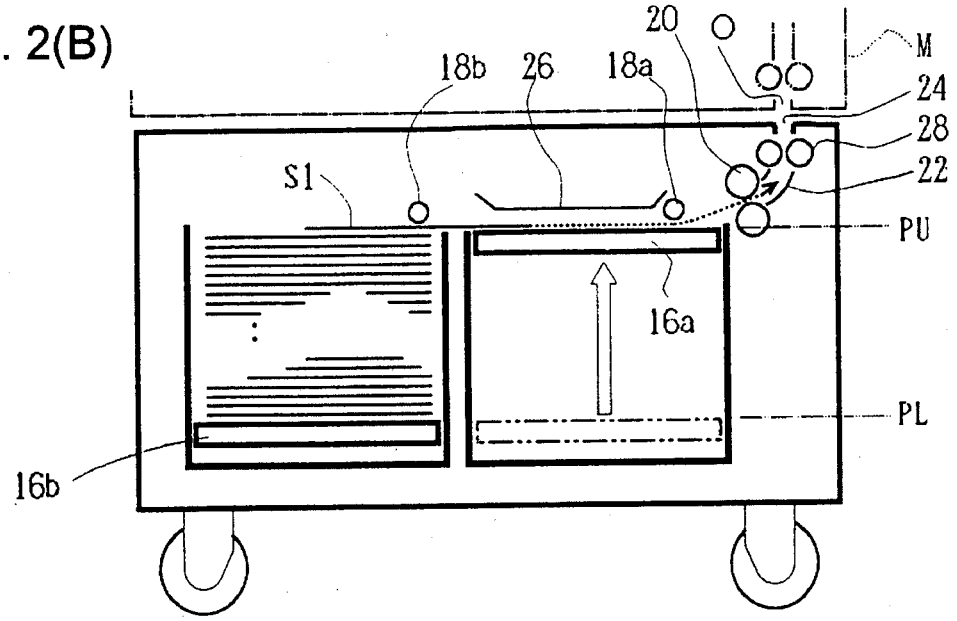

The illustrations of FIGS. 2(A) and 2(B) schematically depict the operating principle of the device of this invention in an easily understandable manner. As illustrated, the sheet feeding device 10 of the invention comprises a first sheet stacker 14*a* and a second sheet stacker 14*b* which are arranged abreast close to each other within a housing 12. The abreast sheet stackers 14*a* and 14*b* are each provided with an elevating tray 16*a* or 16*b*. Although the sheet stacker can generally accommodate hundreds to thousands of sheets SS, the number of such sheets contained in the sheet stacker is by no means limitative.

The elevating trays 16*a* and 16*b* are movable vertically within the range between a lower limit position PL and an upper sheet send-out position PU indicated by a chain line in FIG. 2(B). However, the elevating tray can rise over the upper sheet send-out position PU as occasion calls. The sheet send-out position PU and lower limit position PL are defined herein on the basis of the upper surface of the elevating tray for the sake of convenience.

The elevating trays 16*a* and 16*b* are positioned at the lower limit position PL when the sheets are loaded into the sheet stackers, and move upward in accordance with the amount of the sheets stacked thereon while the sheets are fed out one by one from the sheet stackers. That is to say, when the sheets are sent out, the elevating tray is controlled to take its position so that the uppermost sheet S1 of the sheets SS stacked on the tray is always situated at the sheet send-out position PU.

The sheet stackers 14*a* and 14*b* each have a sheet draw-out roller 18*a* or 18*b* placed so as to come in touch with the upper sheet send-out position PU. Thus, when the sheets stacked on the elevating trays 16*a*, 16*b* are sent out from the sheet stackers, the sheet draw-out rollers 18*a*, 18*b* come in frictional contact with the uppermost of the sheets SS stacked on the trays, respectively. Accordingly, by rotating the draw-out roller, the uppermost sheet S1 is sent out through the sheet exit of each sheet stacker.

At the sheet exit of the first sheet stacker 14*a*, there is disposed sheet separating means 20 composed of a pair of sheet separation rollers which have different frictional coefficients and are rotated in the same direction. To be more specific, the sheet separating means 20 may be formed of a main roller which has a peripheral surface having a relatively large frictional coefficient and is rotated in the forwarding direction, and an auxiliary roller which has a peripheral surface having a relatively small frictional coefficient and is rotated in the opposite direction, consequently to exert a propelling force on the sheet to be fed. As a result, a single sheet nipped between the rotating rollers is normally forwarded chiefly by the main roller having a larger frictional coefficient. However, if two sheets are introduced one on another into between the rollers, only one sheet being in direct contact with the main roller having a larger frictional coefficient is permitted to pass therethrough, and the other sheet being contact with the auxiliary roller having a smaller frictional coefficient is prevented from passing therethrough. Thus, the so-called "double feed phenomenon" can be prevented. To fulfill the effect of preventing the double feed phenomenon, the auxiliary roller of the sheet separating means may of course remain stationary. In this case, a friction pad may be substituted for the auxiliary roller.

The sheet S1 passing through the sheet separating means 20 is sent to a sheet discharge port 24 via a sheet transfer path 22 and introduced into the image processing device M through the sheet inlet opening O.

In the drawings, reference numeral 26 denotes a guide member disposed above the upper sheet send-out position PU of the first sheet stacker 14*a*, numeral 28 denotes feed rollers mounted in the sheet transfer path 22, and numeral 30 denotes moving means such as caster wheels.

The operation of the aforementioned sheet feeding device of this invention will be described hereinafter.

First, a plurality of sheets SS are stacked on the respective sheet elevating trays 16*a* and 16*b* in the sheet stackers 14*a* and 14*b*. As a practical matter, the sheets SS may be supplied to at least any one sheet stacker.

In an initial state, the sheets stacked on the respective trays are held with the uppermost sheets being in contact with the sheet draw-out rollers 18*a* and 18*b*.

When an image processing command is given to the image processing device M, the sheet draw-out roller 18*a* of the first sheet stacker 14*a* in which the sheets are stored starts to rotate at the time that the image processing device M is operated, thereby to send out the uppermost sheet S1 of the sheet stack SS toward the separating means 20 disposed at the sheet exit of the first sheet stacker 14*a*. Even if two or more sheets are discharged by the sheet draw-out roller 18*a*, only one sheet is permitted to pass through the separating means 20 as touched on earlier. Thus, the sheet discharged from the first stacker 14*a* is delivered via a sheet transfer path 22 to the sheet discharge port 24 as illustrated in FIG. 2(A), and then, it is fed into the image processing device M through the sheet inlet opening O.

Although the sheets stored in the first sheet stacker is running short as the image processing operation is repeated in the image processing device M, the elevating tray 16*a* rises with decreasing the amount of the sheets SS stacked on the elevating tray so as to bring the uppermost sheet of the sheets SS stacked on the elevating tray 16*a* in resilient contact with the draw-out roller 18*a* at all times.

When the first sheet stacker 14*a* becomes empty of sheet, the elevating tray 16*a* remains stationary at the upper sheet send-out position PU as shown in FIG. 2(B). In this state, when a further image processing command is given to the image processing device M, the sheet draw-out roller 18*b* of the second sheet stacker 14*b* in which the sheets are contained starts to rotate, thereby drawing out the uppermost sheet S1 of the sheets SS stacked on the elevating tray 16*b* and sending it into the first stacker 14*a*. The sheet sent out from the second sheet stacker 14*b* is then forwarded by the sheet draw-out roller 18*a* toward the sheet separating means 20 along the upper surface of the elevating tray 16*a* held at the sheet send-out position PU. After that, the sheet sent out from into the first sheet stacker 14*a* passes through the sheet separating means 20 and fed into the image processing device M via the sheet transfer path 22 in the same manner as the sheets which are supplied to the first sheet stacker 14*a* from the beginning are sent out via the sheet transfer path 22.

As is seen from the foregoing, the elevating tray 16*a* of the first sheet stacker 14*a* serves as "sheet guiding means" for the sheet sent out from the second sheet stacker 14*b*. Therefore, the sheet feeding device of this invention has no need for an independent sheet transfer path for the exclusive use of the sheets contained in the second sheet stacker 14*b*.

Although the second sheet stacker may be provided with necessitates sheet separating means similar to the means 20 for permitting only one sheet to pass, only a single sheet separating means disposed at the sheet exit of the first sheet stacker suffice for the first and second sheet stackers because the sheets which are sent from the second or successive sheet stackers other than the first sheet stacker 14*a* to the first sheet stacker 14*a* are handled the very same as the sheets supplied to the first sheet stacker at the outset. Thus, only one set of the sheet separating means and sheet transfer path is sufficient for one sheet feeding unit consisting of a plurality of sheet stackers. Accordingly, the sheet feeding device of this invention can be constructed very simply, and make it possible to feed the sheets rationally to the image processing device.

The sheet feeding unit is fundamentally composed of two or more sheet stackers in the same manner as above. In a case that the sheet feeding unit has three or more sheet stackers, the sheet feeding device can more enjoy the benefits of the simplification brought about by the present invention.

In order to fulfill the aforementioned function of reliably sending out the sheets from the second sheet stacker when the first sheet stacker is emptied, a control system including sensors for detecting the sheets stacked on the respective elevating trays, driving means for vertically moving the elevating trays and so on is required. The control system will be explained later.

Figure 3:
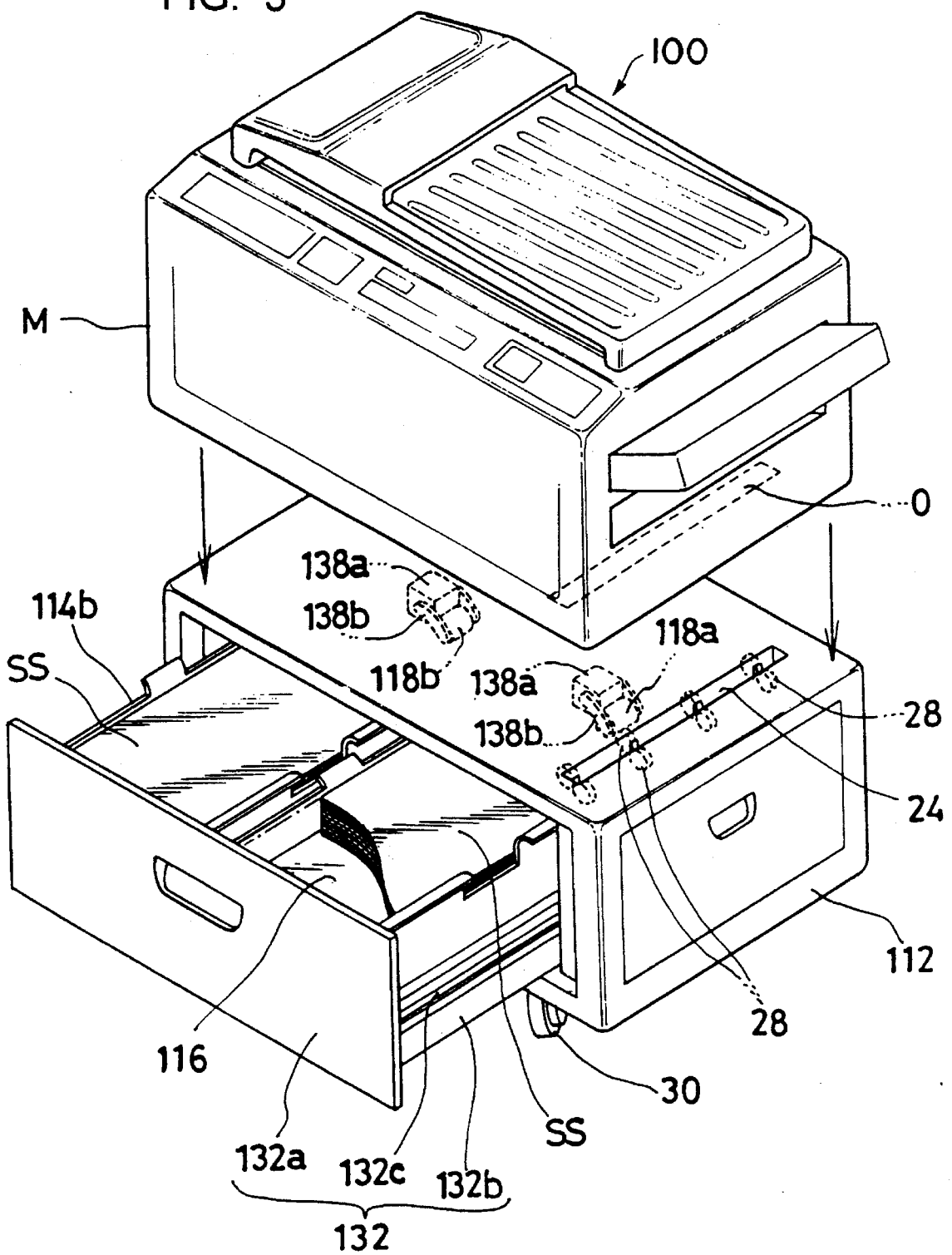
FIG. 3 is a perspective view showing one embodiment of the sheet feeding device of this invention.
Figure 4:
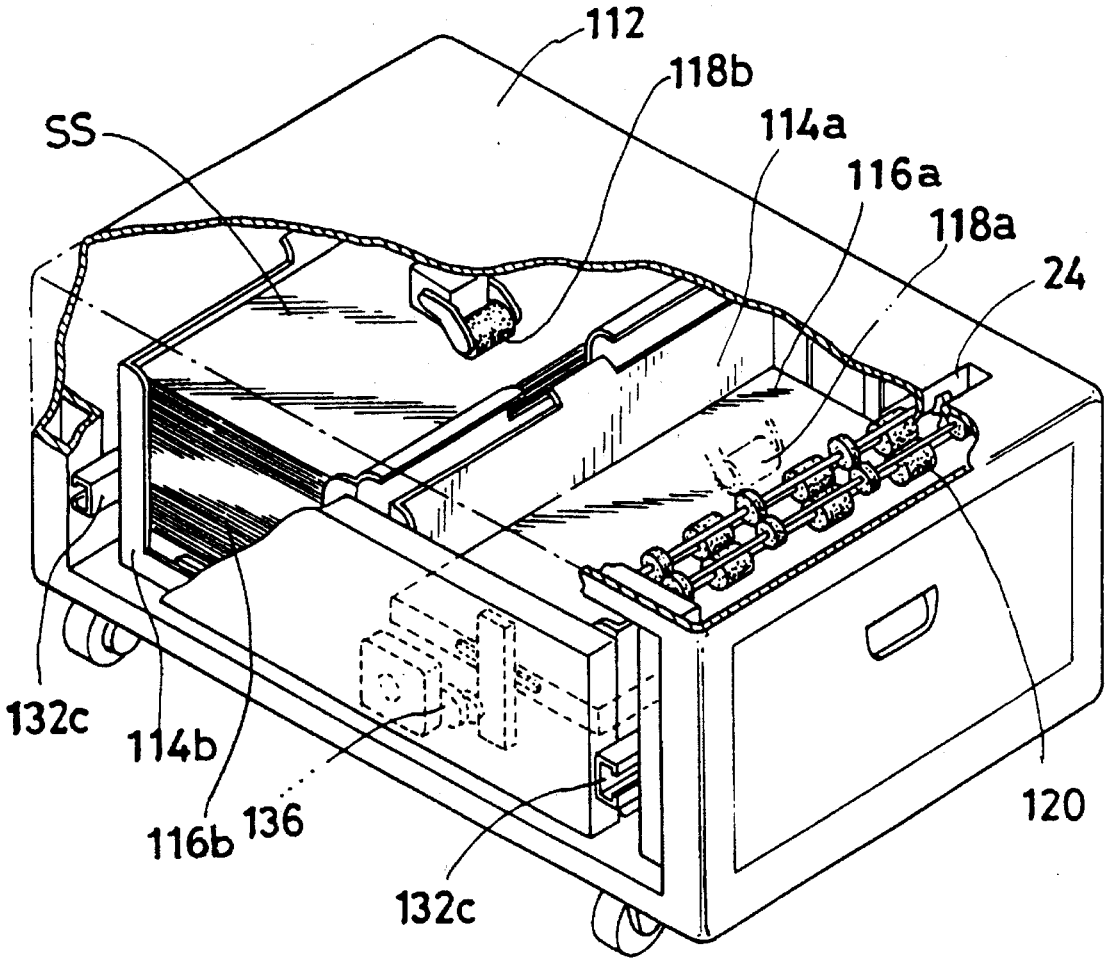
FIG. 4 is a partially cutaway view in perspective of the device of FIG. 3.

The sheet feeding device 100 illustrated in FIGS. 3 and 4 as one embodiment comprises a first sheet stacker 114*a*, and a second sheet stacker 114*b*, which are mounted within a housing 112 and each have an elevating tray 116*a* or 116*b*, respectively.

Figure 5:
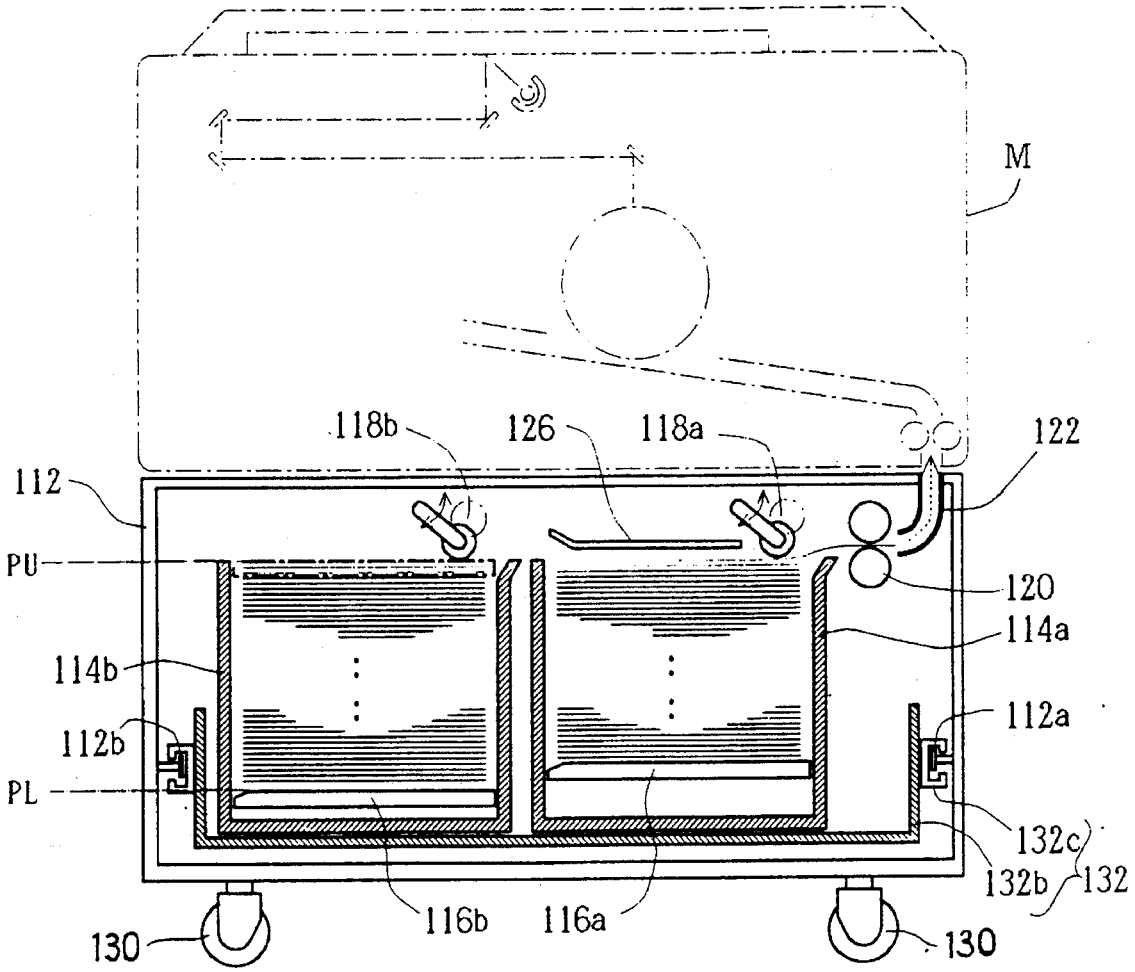
FIG. 5 is a schematic side view of the sheet feeding device of FIG. 3.

As shown in FIG. 5, the elevating trays 116*a* and 116*b* are positioned at the lower limit position PL when the sheets are loaded, and move upwardly in accordance with the amount of the sheets which is decreased as the sheets are delivered one by one to the image processing device, so that the uppermost sheets S1 of the sheets SS stacked on the trays are respectively in resilient contact with sheet draw-out rollers 118*a* and 118*b* at all times. In this state, the sheet draw-out rollers are rotated to send out the uppermost sheets contained in the respective sheet stackers. During the image processing operation executed in the image processing device M, the sheets are fed one by one from the first sheet stacker 114*a* at the first stage, and then, from the second sheet stacker 114*b* when the first sheet stacker 114*a* becomes empty of sheet. When the first sheet stacker 114*a* is emptied, the elevating tray 116*a* in the first sheet stacker 114*a* remains stationary at the upper sheet send-out position PU so as to function as a means for guiding the sheet sent from the second sheet stacker 114*b*. Thus, the sheet sent from either of the first and second sheet stackers (114*a*, 114*b*) is successfully fed to the image processing device M through sheet separating means 120 and a sheet transfer path 122.

The sheet stackers 114*a* and 114*b* are retained within a drawer 132 which can be pulled out of the housing 112 to open the stackers as shown in FIG. 3. The drawer 132 in this embodiment comprises a front panel 132*a*, a support frame 132*b* extending backward from the front panel 132*a* for carrying the sheet stackers 114*a* and 114*b*, and sliding means 132*c*. The sliding means 132*c* may be formed of angle rails as illustrated and supported movably in the horizontal direction by rollers 112*a* fixed on the opposite side walls of the housing 112.

Thus, by pulling out the drawer 132 from the housing 112, loading of the sheets in the sheet stackers and maintenance of the device can be carried out with ease.

The drawer 132 is provided with tray-driving means 136 for moving vertically the elevating trays 116*a* and 116*b* in the sheet stackers 114*a* and 114*b*. By controlling the tray-driving means 136, each elevating tray can be positioned at the lower limit position PL when loading the sheets in the sheet stacker, and lifted up in accordance with the amount of the sheets SS stacked thereon so as to bring the uppermost of the sheets SS at the upper sheet send-out position PU in resilient contact with the sheet draw-out roller (118*a* or 118*b*). When pulling out the drawer 132 from the housing 112, the sheet draw-out rollers 118*a*, 118*b* retract upward as indicated by chain lines in FIG. 5 so as not to interfere the drawer being pulled out or pushed in.

In the drawings, reference numeral 126 denotes a guide member disposed above the upper sheet send-out position PU of the first sheet stacker 114*a*, and numeral 130 denotes moving means such as caster wheels.

Figure 6:
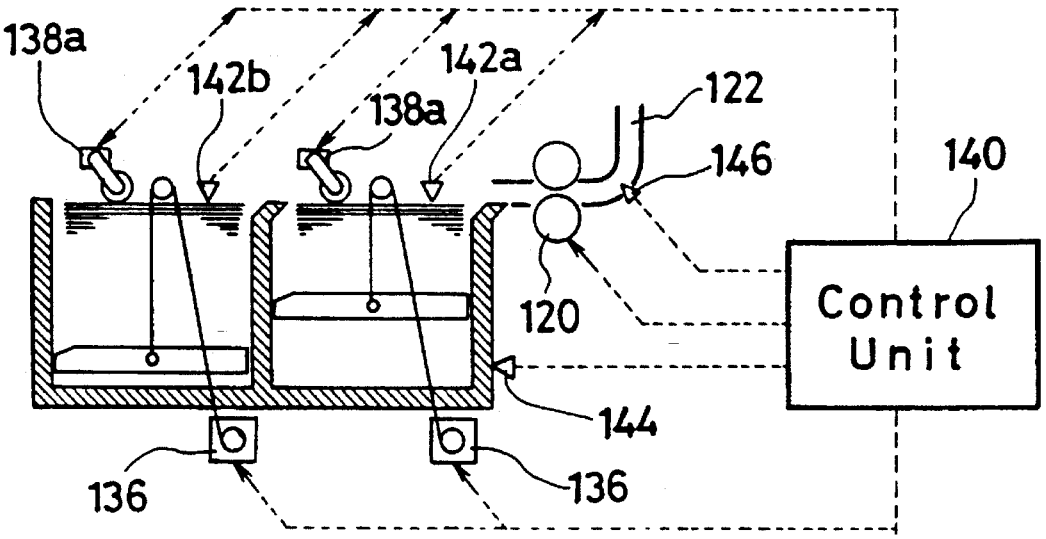
FIG. 6 is a schematic view indicating diagrammatically one example of a control system for controlling the sheet feeding device of this invention.

The sheet draw-out rollers 118*a* and 118*b*, driving means 138*a* for driving the draw-out rollers, tray-driving means 136 and sheet separating means 120 are collectively controlled by a control system including a control unit 140 as schematically illustrated in FIG. 6. To be specific, the elevating trays 116*a* and 116*b* are driven in accordance with output signals from sheet sensors 142*a* and 142*b* for detecting the sheets stored in the sheet stackers 114*a* and 114*b*, so that the uppermost sheets of the sheet stacks on the trays or the upper surfaces of the trays are brought into resilient contact with the sheet draw-out rollers 118*a* and 118*b* during the image processing operation. The sheet feeding device is provided with a sensor 144 for detecting the conditions of the sheet stackers. According to the signal outputted from the sensor 144, the control unit operates to deactivate the sheet feeding device and cause the sheet draw-out rollers 118*a* and 118*b* to retract upward when the drawer is out of the housing 112.

A sensor 146 mounted on the sheet transfer path 122 has a function of detecting the sheet traveling via the sheet transfer path 122 in order to prevent the failure of feeding and operating the working elements including the sheet draw-out rollers, sheet separating means, and tray-driving means synchronously with one another.

Since the control system as described above is not particularly novel and has been adopted in the conventional sheet feeding device of this type, it is not explained herein in detail. The process of activating the sheet feeding device of the invention for feeding the sheets to the image processing device M one by one under the control of the aforementioned control system will be described hereinafter.

First, upon setting the sheets SS on the respective sheet elevating trays 116*a* and 116*b* in the sheet stackers 114*a* and 114*b* with the drawer 132 held out of the housing 112, the drawer 132 is inserted into the housing 112. Thereupon, the elevating trays are moved upward so as to position the uppermost of the sheets stacked on the trays at the sheet send-out position, and then, the sheet draw-out rollers 118*a* and 118*b* are actuated to come in resilient contact with the uppermost of the sheets stacked on the elevating trays, respectively.

When an image processing command is given to the image processing device M, the sheet draw-out roller 118*a* of the first sheet stacker 114*a* in which the sheets are stored starts to rotate at the time that the image processing device M is operated, thereby sending out the uppermost sheet S1 of the sheet stack SS in the first stacker 114*a* toward the separating means 120 disposed at the sheet exit of the first sheet stacker 114*a*. The sheet discharged from the first stacker 114*a* is forwarded via a sheet transfer path 122 to the sheet discharge port 24, and then, it is delivered to the image processing device M.

When the first sheet stacker 114*a* becomes empty of sheet, the elevating tray 116*a* remains stationary at the upper sheet send-out position PU. In this state, when a further image processing command is given to the image processing device M, the sheet draw-out roller 118*b* of the second sheet stacker 114*b* in which the sheets are contained starts to rotate, thereby to send out the uppermost sheet S1 of the sheets SS stacked on the elevating tray 116*b*. The sheet sent out from the second sheet stacker 114*b* is forwarded by the sheet draw-out roller 118*a* toward the sheet separating means 120 along the upper surface of the elevating tray 16*a* retained at the sheet send-out position PU. The sheet sent entering into the first sheet stacker 114*a* passes through the sheet separating means 120 and fed into the image processing device M via the sheet transfer path 122 in the same manner as the sheets which are supplied to the first sheet stacker 114*a* from the beginning.

According to this embodiment described above, the sheets contained in not only the first sheet stacker 114*a* but also the second sheet stacker 114*b* can be effectively sent through one sheet transfer path 122 extending from the sheet exit of the first sheet stacker 114*a* to the discharge port 124 without need for an independent sheet transfer path for the exclusive use of the sheets stored in the second sheet stacker 114*b*. Thus, the sheet feeding device can be remarkably simplified in structure and decreased in weight, with the result that frequency of misfeeding can be reduced and the image processing system can be manufactured at a low cost.

Figure 7:
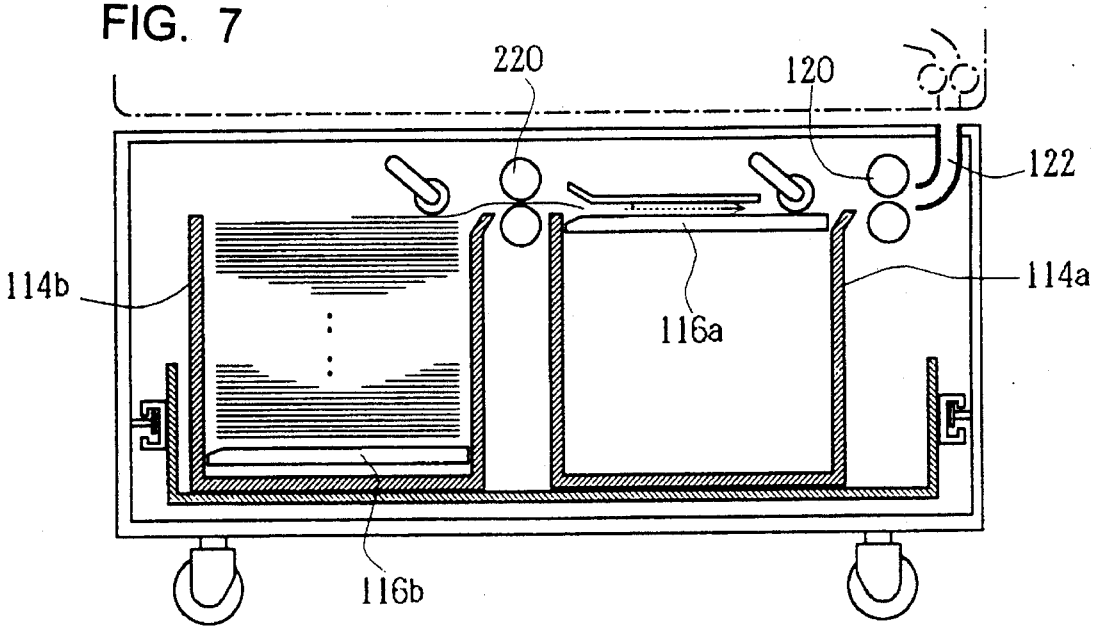
FIG. 7 is a schematic side view of another embodiment of this invention.

Although the foregoing embodiment is provided at the sheet exit of the first sheet stacker with one sheet separating means, another sheet separating means 220 may be mounted at the sheet exit of the second sheet stacker 114*b*, i.e. between the first sheet stacker 114*a* and the second sheet stacker 114*b* as shown in FIG. 7. According to this embodiment, only one sheet can be reliably sent out from the second sheet stacker 114*b*, thereby to reduce frequency of causing the double-feed phenomenon.

Figure 8:
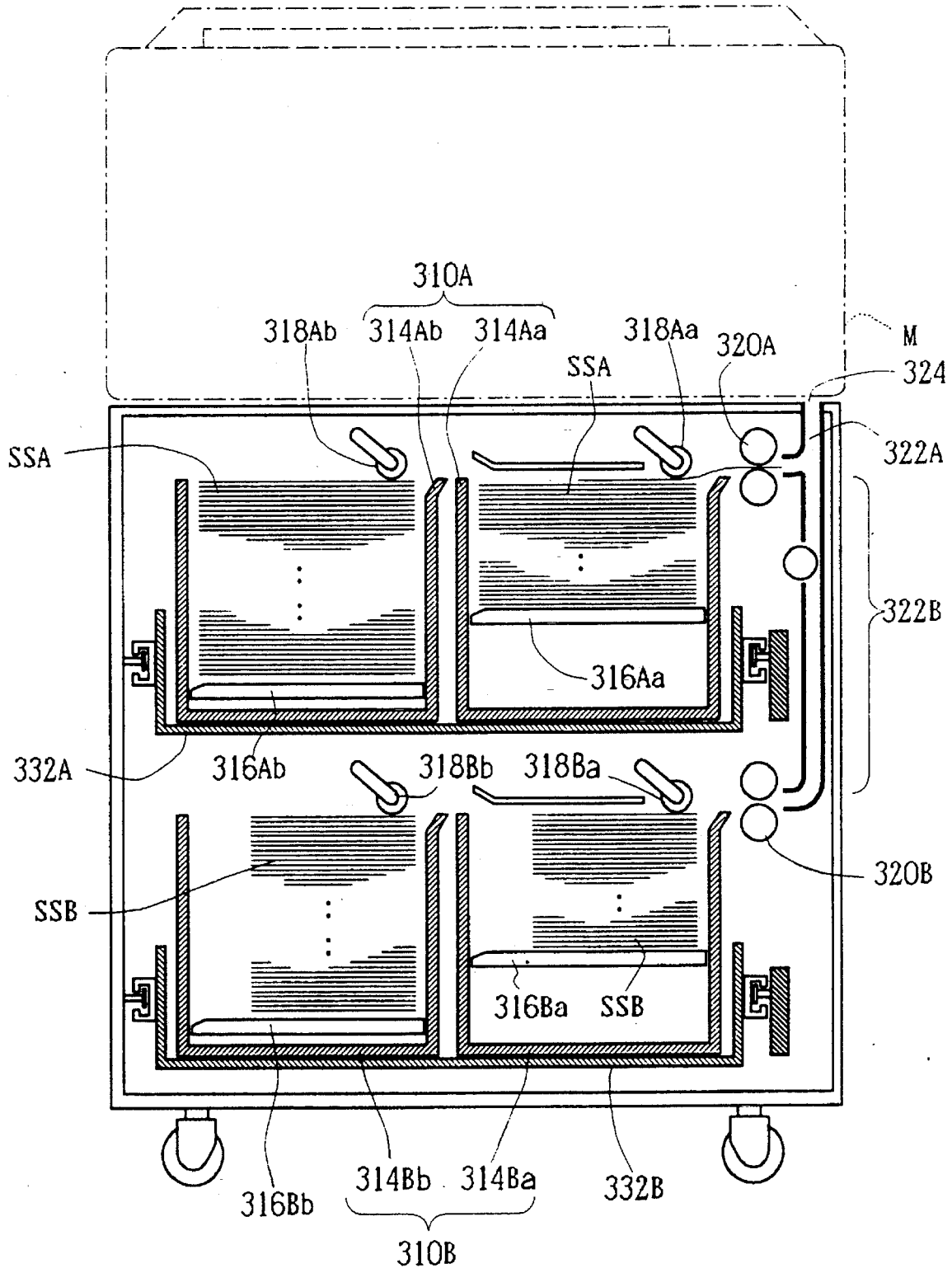
FIG. 8 is a schematic side view of still another embodiment of this invention.

FIG. 8 depicts a sheet feeding device of the invention which comprises two sheet feeding units 310A and 310B each having two sheet stackers arranged side by side. The sheet stackers 314A*a*, 314A*b*, 314B*a*, 314B*b* each have a sheet draw-out roller (318A*a*, 318A*b*, 318B*a*, 318B*b*) and an elevating tray (316A*a*, 316A*b*, 316B*a*, 315B*b*). The two sheet feeding units 310A and 310B are placed one upon another. The sheet stackers may contain the sheets having the same size in all the units, or different sizes in the upper and lower units. When the sheets in all the sheet stackers have the same size, they are sent out from the first sheet stacker 314A*a* to the fourth sheet stacker 314B*b* in succession.

When the first and second sheet stackers 314A*a* and 314A*b* are loaded with first stacks of sheets SSA having the same size and the third and fourth sheet stackers 314B*a* and 314B*b* are loaded with second stacks of sheets SSB of different size from the first sheets SSA as illustrated, the sheets contained in the sheet stackers in the first and second units 310A and 310B are selectively sent out, respectively. In this case, when the sheet contained in the first unit 310A is selected, the sheet is discharged from the first or second sheet stacker 314A*a* or 314A*b* by operating the sheet draw-out roller or rollers (318A*a*, 318A*b*), passes through first separating means 320A disposed at the sheet exit of the first stacker 314A*a* and is fed into the image processing device M via a first sheet transfer path 322A and a discharge port 324. When the sheet contained in the second unit 310B is selected, the sheet is discharged from the third or fourth sheet stacker 314B*a* or 314B*b* by operating the sheet draw-out roller or rollers (318B*a*, 318B*b*), passes through second separating means 320B disposed at the sheet exit of the third stacker 314B*a* and is forwarded along a second sheet transfer path 322B into the first sheet transfer path 322A and delivered to the image processing device M through a discharge port 324.

According to this embodiment, the sheet feeding device can be remarkably simplified in structure, and moreover, a mass of sheets can readily be dealt with without frequent loading of sheets into the sheet stackers.

Figure 9:
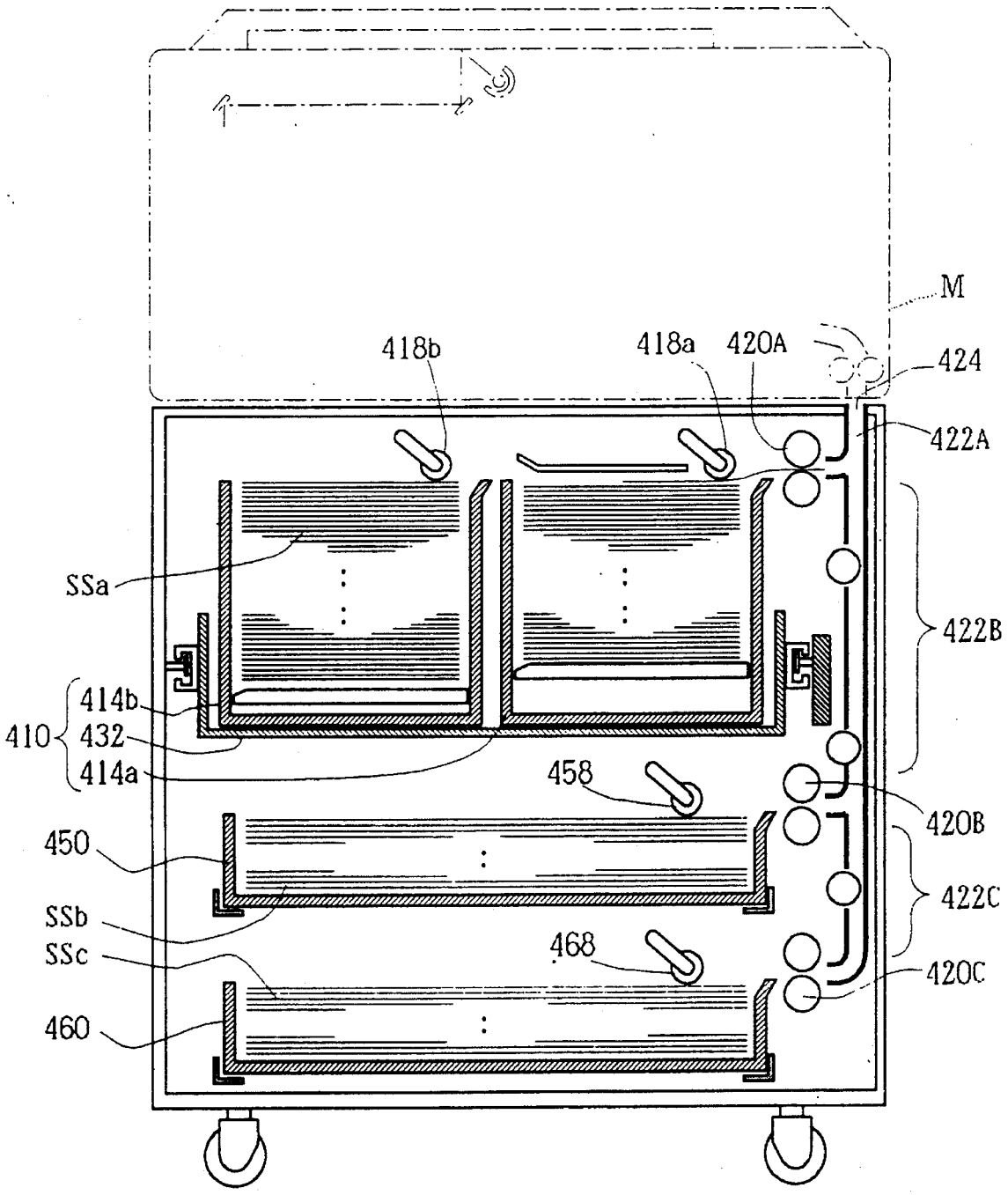
FIG. 9 is a schematic side view of yet another embodiment of this invention.

In the sheet feeding device illustrated in FIG. 9, two sheet cartridges 450 and 460 are employed in place of the second sheet feeding unit 310B of the foregoing embodiment of FIG. 8. The sheet cartridges 450 and 460 are disposed below a sheet feeding unit 410 comprising abreast sheet stackers 414*a* and 414*b* held on a drawer 432, and can accommodate sheets SS*b* and SS*c* which are larger in size than the maximum sheet SS*a* which the sheet stackers 414*a* and 414*b* can contain. The sheets SS*b* and SS*c* contained in the cartridges 450 and 460 may of course be different in size.

When a command for feeding the sheet SS*a* is given to the sheet feeding device, one sheet is discharged from the sheet stack SS*a* in the sheet stacker 414*a* or 414*b* by operating sheet draw-out roller 418*a* or rollers 418*a* and 418*b* and sent into the image processing device M through sheet separating means 420A and a sheet transfer path 422A. When the sheet SS*b* or SS*c* is selected, either draw-out roller 458 or 468 is driven to draw out the desired sheet from the cartridge 450 or 460. The sheet sent out from the cartridge 450 passes through sheet separating means 420B and is forwarded via a second transfer path 422B and the first transfer path 422A and delivered to the image processing device M through a discharge port 424. The sheet from the cartridge 460 is delivered along a third transfer path 422C to the image processing device M in the same manner.

Although the sheet feeding unit in the embodiment described above comprises two sheet stackers, the number of the stacker in each unit is not limited as stated repeatedly. Also, though the sheet cartridges 450, 460 are arranged below the sheet feeding unit 410, the arrangement may be reversed, i.e. the cartridges may be disposed above the unit 410 or optionally arranged in various forms.

As is apparent from the foregoing description, the sheet feeding device of the present invention is provided with the abreast sheet stackers in which the elevating trays are disposed movably vertically in accordance with the amount of the sheets stacked thereon and can be held at the upper sheet send-out positions when the relevant sheet stackers become empty of sheet, so as to guide the sheet sent out from the succeeding sheet stackers. Accordingly, the sheet feeding mechanism of the device can be drastically simplified without deteriorating the sheet feeding performance. Thus, the high-performance sheet feeding device of the invention can be made simple and light, and therefore, the system including this device can be manufactured at a low cost.

It is to be understood that the invention is not limited in its application to the details of construction and arrangement of parts illustrated in the accompanying drawings, since the invention is capable of other embodiments and of being practiced or carried out in various ways. Also it is to be understood that the phraselogy or terminology employed herein is for the purpose of description and not of limitation.

What is claimed is:

1. A sheet feeding device for feeding sheets one by one to an image processing device, comprising at least first and second sheet stackers arranged abreast and each having an elevating tray for stacking the sheets thereon, said first and second sheet stackers each having a sheet draw-out roller for discharging the sheets stacked on said elevating tray of each of said stackers, said first sheet stacker being provided with a sheet exit through which the sheets are sent out one by one by its sheet draw-out roller, and a sheet transfer path extending from the sheet exit of said first sheet stacker to the image processing device for delivering the sheet sent out from said first sheet stacker to the image processing device, said elevating tray in said first sheet stacker being held at an upper sheet send-out position defined in said first sheet stacker, when said first stacker is empty of sheet, so as to feed the sheet from said second sheet stacker to the image processing device through said first sheet stacker by operating said sheet draw-out rollers of said first and second sheet stackers.

2. A sheet feeding device according to claim 1, further comprising sheet separating means disposed at the sheet exit of said first sheet stacker for permitting only one sheet to pass therethrough.

3. A sheet feeding device according to claim 2, wherein said sheet separating means is composed of a pair of rollers.

4. A sheet feeding device according to claim 1, further comprising sheet separating means disposed at the sheet exit of said first sheet stacker for permitting only one sheet to pass therethrough, and another sheet separating means disposed between said first and second sheet stackers for permitting only one sheet from said second sheet stacker to pass therethrough.

5. A sheet feeding device according to claim 1, further comprising a guide member disposed above the upper sheet send-out position defined in said first sheet stacker.

6. A sheet feeding device according to claim 1, further comprising at least one pair of feed rollers mounted in said sheet transfer path.

7. A sheet feeding device according to claim 1, further comprising moving means formed of caster wheels.

8. A sheet feeding device according to claim 1, wherein said sheet draw-out rollers are retractable upward.

* * * * *